US008701331B2

(12) United States Patent
Schneider et al.

(10) Patent No.: US 8,701,331 B2
(45) Date of Patent: Apr. 22, 2014

(54) ASSEMBLY FOR MOUNTING ON A PICATINNY-TYPE RAIL

(71) Applicant: L.W. Schneider, Inc., Princeton, IL (US)

(72) Inventors: Lloyd Schneider, Princeton, IL (US); Michael Scarantino, Dixon, IL (US); Theresa Quezada, Plainfield, IL (US)

(73) Assignee: L.W. Schneider, Inc., Princeton, IL (US)

( * ) Notice: Subject to any disclaimer, the term of this patent is extended or adjusted under 35 U.S.C. 154(b) by 0 days.

(21) Appl. No.: 13/837,106

(22) Filed: Mar. 15, 2013

(65) Prior Publication Data

US 2013/0212923 A1 Aug. 22, 2013

Related U.S. Application Data

(63) Continuation of application No. 13/029,703, filed on Feb. 17, 2011, now Pat. No. 8,499,484.

(51) Int. Cl.
*F41G 1/387* (2006.01)
*F41G 11/00* (2006.01)

(52) U.S. Cl.
CPC ..... *F41G 11/003* (2013.01)
USPC ..... 42/124

(58) Field of Classification Search
USPC ..... 42/124–128, 90, 85, 148
See application file for complete search history.

(56) References Cited

U.S. PATENT DOCUMENTS

| | | | | |
|---|---|---|---|---|
| 3,750,318 | A * | 8/1973 | Burris | 42/127 |
| 5,155,915 | A * | 10/1992 | Repa | 42/127 |
| 6,598,333 | B1 * | 7/2003 | Randazzo et al. | 42/127 |
| 6,922,934 | B1 * | 8/2005 | Huan | 42/127 |
| 7,308,772 | B1 * | 12/2007 | Millett | 42/127 |
| 8,276,307 | B2 * | 10/2012 | Deros | 42/127 |
| 2007/0163163 | A1 * | 7/2007 | Munst | 42/85 |

* cited by examiner

*Primary Examiner* — Reginald Tillman, Jr.
(74) *Attorney, Agent, or Firm* — McAndrews, Held & Malloy, Ltd.

(57) ABSTRACT

An assembly for mounting on a standard mounting platform, such as a Picatinny-type rail, the assembly provides engaged contact between the rail and the surfaces of a base and a clamp. The clamp is rotatably attached to a base, allowing a user to quickly shift the assembly between a rail-engaging position and a disengaged position. The base also preferably contains a locking mechanism that allows a user to lock the assembly in a rail-engaging position. The assembly is particularly useful for the mounting of accessories, such as scopes and sights, onto Picatinny-type rails that are affixed to firearms.

10 Claims, 6 Drawing Sheets

ASSEMBLY FOR MOUNTING ON A PICATINNY-TYPE RAIL

RELATED APPLICATIONS

This application claims priority to, and is a continuation of, U.S. application Ser. No. 13/029,703 having a filing date of Feb. 17, 2011 which is incorporated herein by reference in its entirety.

BACKGROUND OF THE INVENTION

1. Field of the Invention

The present invention relates generally to an assembly which may be releasably mounted on a standard mounting platform, such as a Picatinny-type rail. More particularly, an embodiment relates to a quick attachment, quick release mounting assembly, by which a variety of accessories can be quickly and easily secured to a mounting rail that may be affixed to a gun.

2. Description of the Related Art

The increasing complexity of combat has generated a need for weapons with increased accuracy and which are capable of supporting a variety of accessories. These accessories include, for example, scopes, sights, laser spotters, and flashlights. Consequently, a variety of mounting systems for rifles and other firearms have been developed. These mounting systems most commonly utilize Picatinny-type rails, which are affixed to the barrel or stock of the weapon. Accessories are mounted onto the rails by a number of different methods.

When dealing with the mounting of an accessory on a gun, it is of primary importance that the accessory remains firmly secured to the rail. At the same time, it is desirable that the accessory be quickly and easily securable to and removable from the rail.

A number of U.S. patents provide various configurations of a cam system. For example, U.S. Pat. No. 7,712,242 discloses a rail clamp apparatus for mounting an accessory device to a Picatinny rail that utilizes a horizontal cam lock. The apparatus comprises first and second rail-engaging surfaces opposed to and transversely separated from one another and a cam mechanism that imparts transverse movement to one of the rail-engaging surfaces when actuated by a handle. Accordingly, the apparatus is placed on top of the rail and by rotating the handle, the cam brings the two rail-engaging surfaces toward each other and into contact with the corresponding surfaces of the rail.

U.S. Pat. No. 7,493,721 discloses a configuration of rail clamp mounting apparatus based on a vertical cam lock. There, the mounting assembly contains a boss formation that extends out to one side of the rail. A vertical camming member contains a shaft extending upwardly through the boss formation and a foot. When the camming member is actuated, the foot engages the rail and acts as a clamping device. An actuator arm at the top of the shaft provides a means for the user to rotate the shaft and engage the foot against the bottom surface of the rail mounting projection.

U.S. Pat. No. 7,272,904 discloses a rail clamp mounting apparatus that utilizes a locking plate having angulated cam surfaces for forcibly engaging the lower angulated surfaces of the rail. As manual force is applied to a locking lever, the cam plate rotates. Due to its design, the clamping force of the cam surface increases the further that it is rotated, i.e. the more force is applied to the locking lever. Eventually, a maximum clamping force is achieved, as determined by the setting of an adjustable locking nut.

SUMMARY OF THE INVENTION

The present invention provides an assembly for mounting onto rails, such as Picatinny-type rails. An embodiment of the mounting assembly can be used, for example, in connection with rails that are affixed to firearms, such as rifles of the M16 family and the like, thereby providing a variety of accessories that may be releasably mounted to the firearm.

The mounting assembly includes a base having at least a first rail-engaging surface and a clamp rotatably mounted to the base by a pivot and having at least a second rail-engaging surface. The clamp pivots with respect to the base to move the second rail-engaging surface between an engaged position where the assembly engages a rail between the first and second rail-engaging surfaces and a disengaged position where the assembly disengages a rail. An embodiment of the mounting assembly also includes a locking mechanism having a locked position that locks the clamp in its engaged position. The unlocked position of the locking mechanism allows the clamp to move between its engaged and disengaged positions.

In order to mount an accessory onto a rail using the mounting assembly, a user first brings the clamp into a disengaged position. The user then places the accessory on the rail in the desired location, and brings the clamp into a rail-engaging position. In an embodiment, a user may lock the accessory in place by placing the locking mechanism in its locked position. To remove the accessory, a user first ensures that any locking mechanism is in its unlocked position. The user next brings the clamp into a disengaged position, allowing for the removal of the accessory from a rail.

In certain embodiments, the mounting device can be both mounted to a rail and removed from the rail using a single hand. Additionally, in certain embodiments, a simple, compact mounting device is provided that will withstand the stresses of combat well, avoiding moving parts on the outside of the device that could become clogged with dirt, mud or sand, or be bent, twisted, or broken.

For a better understanding of the invention, its operating advantages, and the specific objects attained by its uses, reference should be had to the accompanying drawings and descriptive matter in which there is illustrated a preferred embodiment of the invention.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

The mounting assembly is configured to provide a secure engagement between a device and a Picattiny-type rail. More particularly, an embodiment of the mounting assembly is designed to provide a secure engagement between a firearm accessory and a Picattiny-type rail affixed to a firearm.

Picatinny-type rails are affixed to a firearm to provide a surface for the mounting of accessories onto the firearm. Accessories that are typically mounted on a rail of a firearm include lighting devices and optical accessories, such as flashlights, laser spotters, hard sights, flip-up sights, and a variety of scopes. Scopes are typically held in place by a configuration of scope rings, which can include, for example, a single scope ring, a pair of scope rings, or ganged scope rings. Because these accessories are often used for aiming the firearm or measuring firing distances, it is important that the accessories be securely attached to the firearm. It is also desirable that the accessories be quickly and easily attachable to and releasable from a rail, given that a combat situation may call for the use of a particular accessory with little warning.

Though an embodiment is discussed herein particularly as it relates to its use for mounting an accessory to a firearm, it is to be understood that the mounting assembly also has application for supporting devices on a mounting rail that is not affixed to a firearm.

Figure 1:
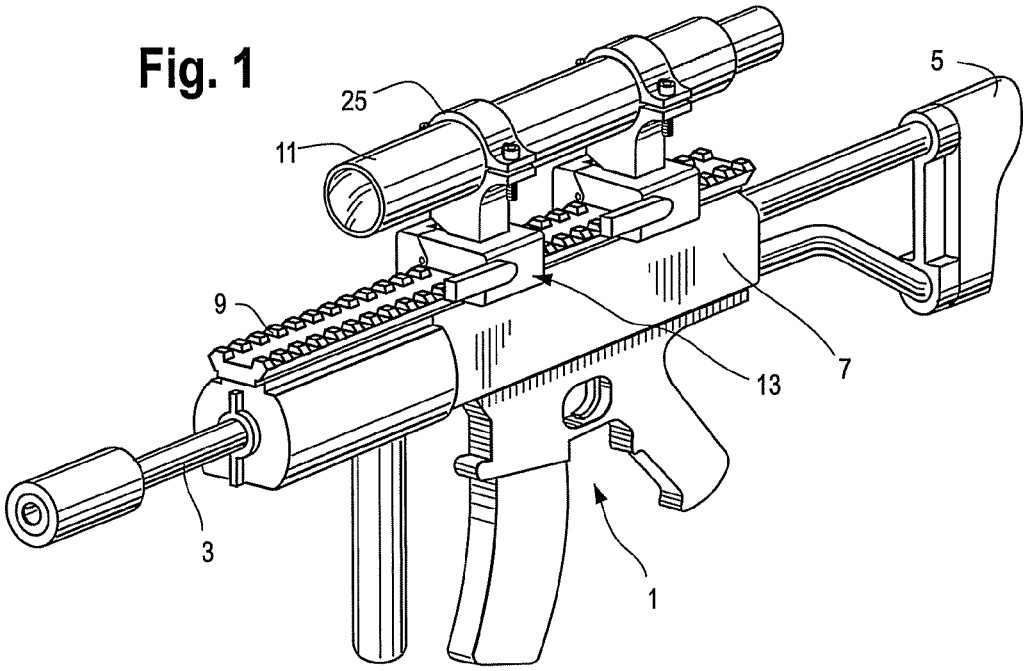
FIG. 1 is a perspective view of a combat firearm having a Picatinny-type rail affixed to its upper chamber and having a scope mounted to the rail through an embodiment of the mounting assembly.

FIG. 1 illustrates a firearm 1 having a barrel 3, a butt stock 5, and a chamber 7. Any type of firearm can be used, for example having a short or a long barrel. The mounting can also be used for other purposes than firearms, such as to mount auxiliary devices on a crossbow, a "shotgun" or highly directional microphone, or a camera. The firearm 1 of FIG. 1 contains a Picatinny-type rail 9 supported on the upper chamber 7. Picatinny-type rails 9, however, may also be affixed to other parts of the firearm 1, including to the barrel 3 or a handle, not shown. Additionally, a number of rails 9 may be affixed to a firearm 1 in different locations. The mounting assembly 13 is not limited by the location of the rail 9 on the firearm 1. In FIG. 1, a scope 11 is mounted to the rail 9 of the firearm 1 using scope rings 25 that utilize an embodiment of the mounting assembly 13.

Figure 2:
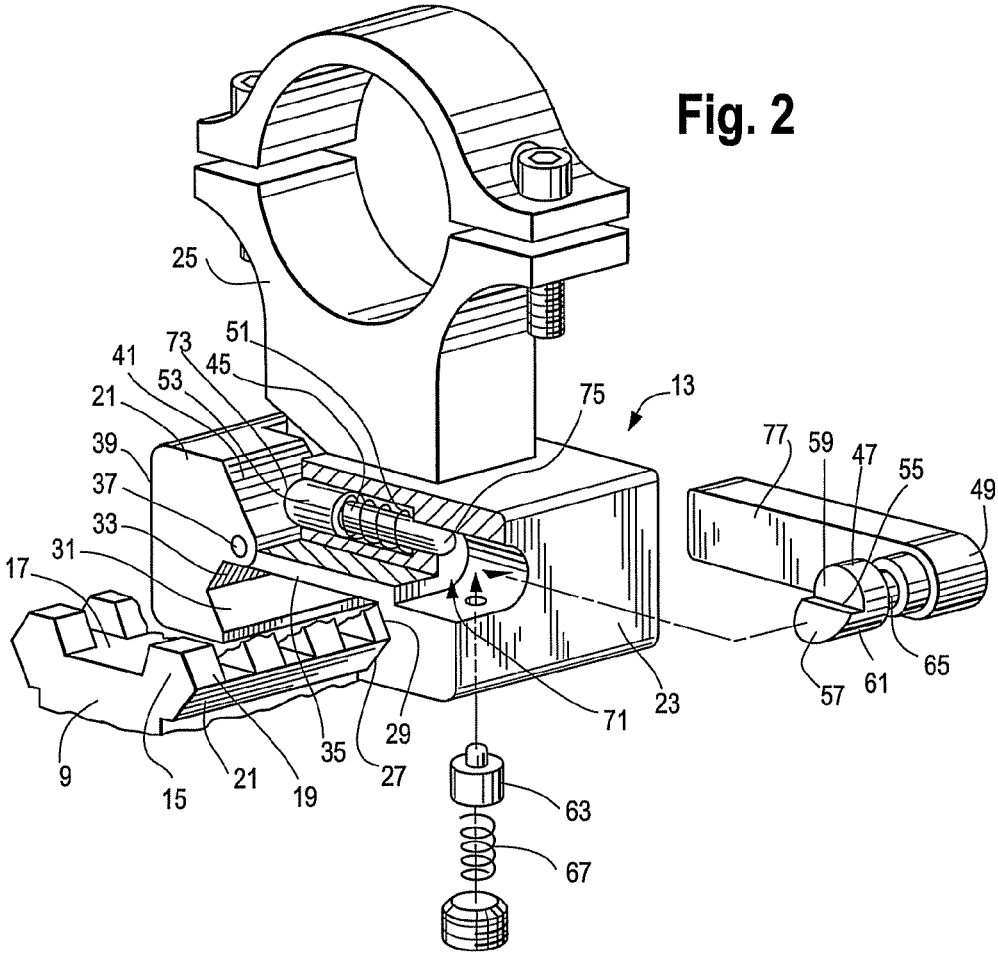
FIG. 2 is an exploded perspective view, partly in section, of an embodiment of the mounting assembly mounted on a Picatinny-type rail.

FIG. 2 shows a perspective view of an embodiment of the mounting assembly 13 mounted on a Picatinny-type rail 9. A Picatinny-type rail 9 comprises a number of mounting projections 15, each separated from the next by evenly spaced transverse slots 17. The mounting projections 15 are defined on each side by an upper mounting surface 19 and a lower mounting surface 21, which are disposed in angulated relation with one another. The most common commercially available Picatinny-type rails are Picatinny rails and Weaver rails.

The illustrated embodiment of the mounting assembly 13 comprises at least a clamp 21 and a base 23. The base 23 is preferably in integral attachment with a firearm accessory, such as a scope ring 25. While FIG. 2 illustrates an embodiment of the mounting assembly containing a scope ring 25, the type of accessory that may be attached to the mounting assembly 13 is in no means limited by the particular embodiment illustrated. Any desired accessory may be configured to be mounted to a rail 9 of a firearm 1 using an embodiment of the mounting assembly 13.

The base 23 comprises at least a first rail-engaging surface 27. Preferably, the base 23 comprises a pair of rail-engaging surfaces 27, 29 that are configured to engage the upper and lower mounting surfaces 19, 21 of one side of a Picatinny-type rail 9. The clamp 21 comprises at least a second rail-engaging surface 31. Preferably, the clamp 21 also comprises a pair of rail-engaging surfaces 31, 33 that are configured to engage the upper and lower mounting surfaces 19, 21 of the other side of a Picatinny-type rail 9. The space between a rail-engaging surface 31 of the clamp 21 and a rail-engaging surface 27 of the base 23 can be described as the mounting cavity 35.

Figure 3:
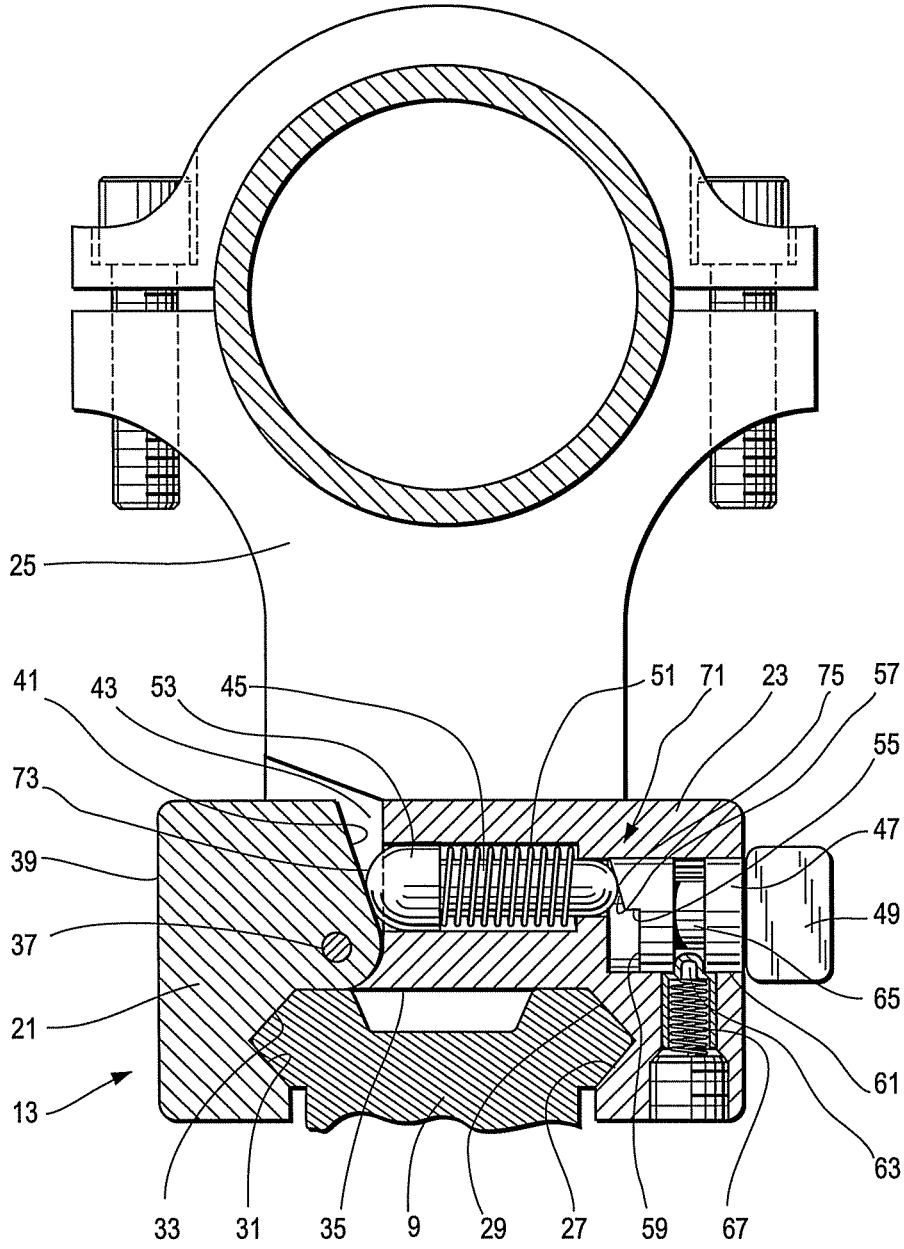
FIG. 3 is a rear elevation view of an embodiment of the mounting assembly with the clamp in an engaged position and an embodiment of a locking mechanism in a locked position.
Figure 4:
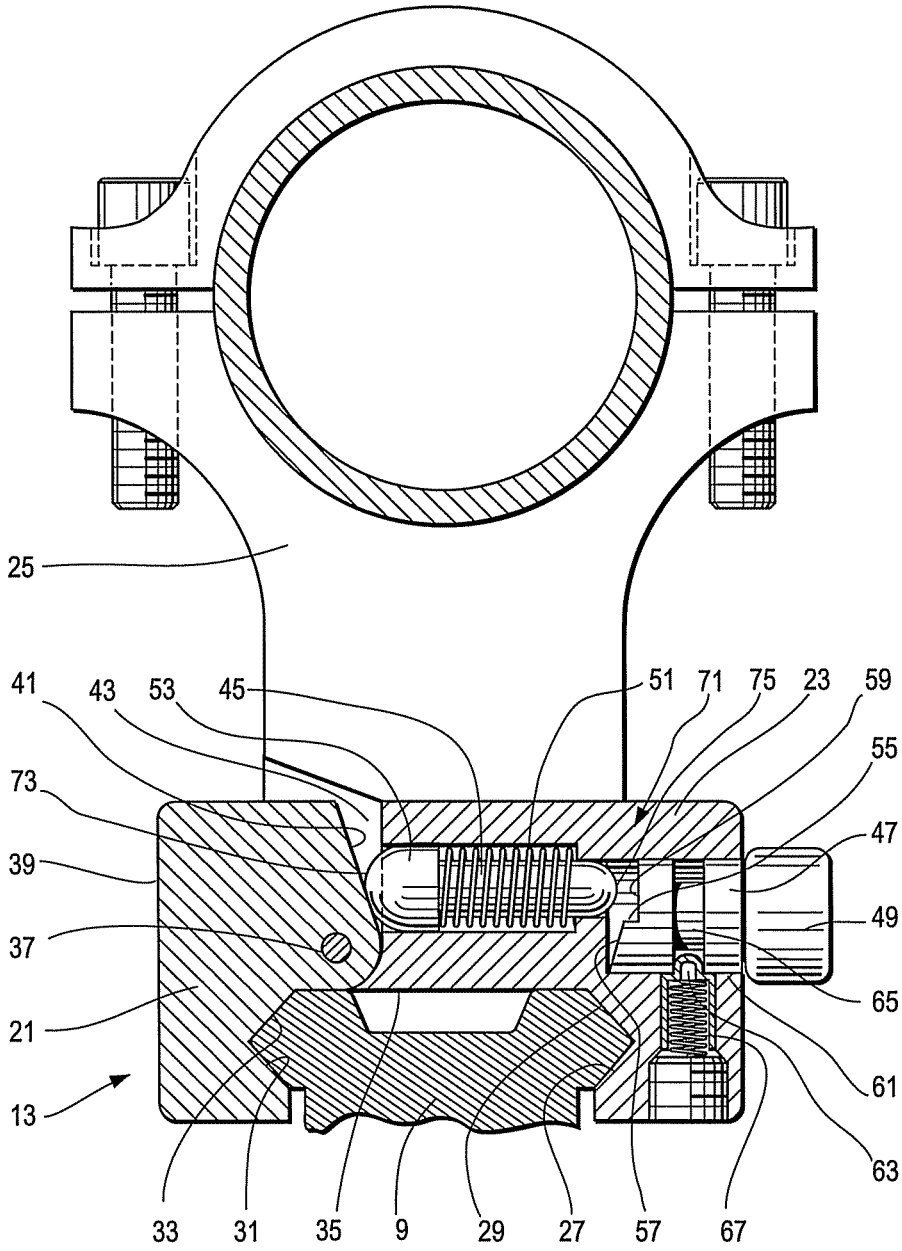
FIG. 4 is a rear elevation view, partly in section, of an embodiment of the mounting assembly with the clamp in an engaged position and an embodiment of a locking mechanism in an unlocked position.
Figure 5:
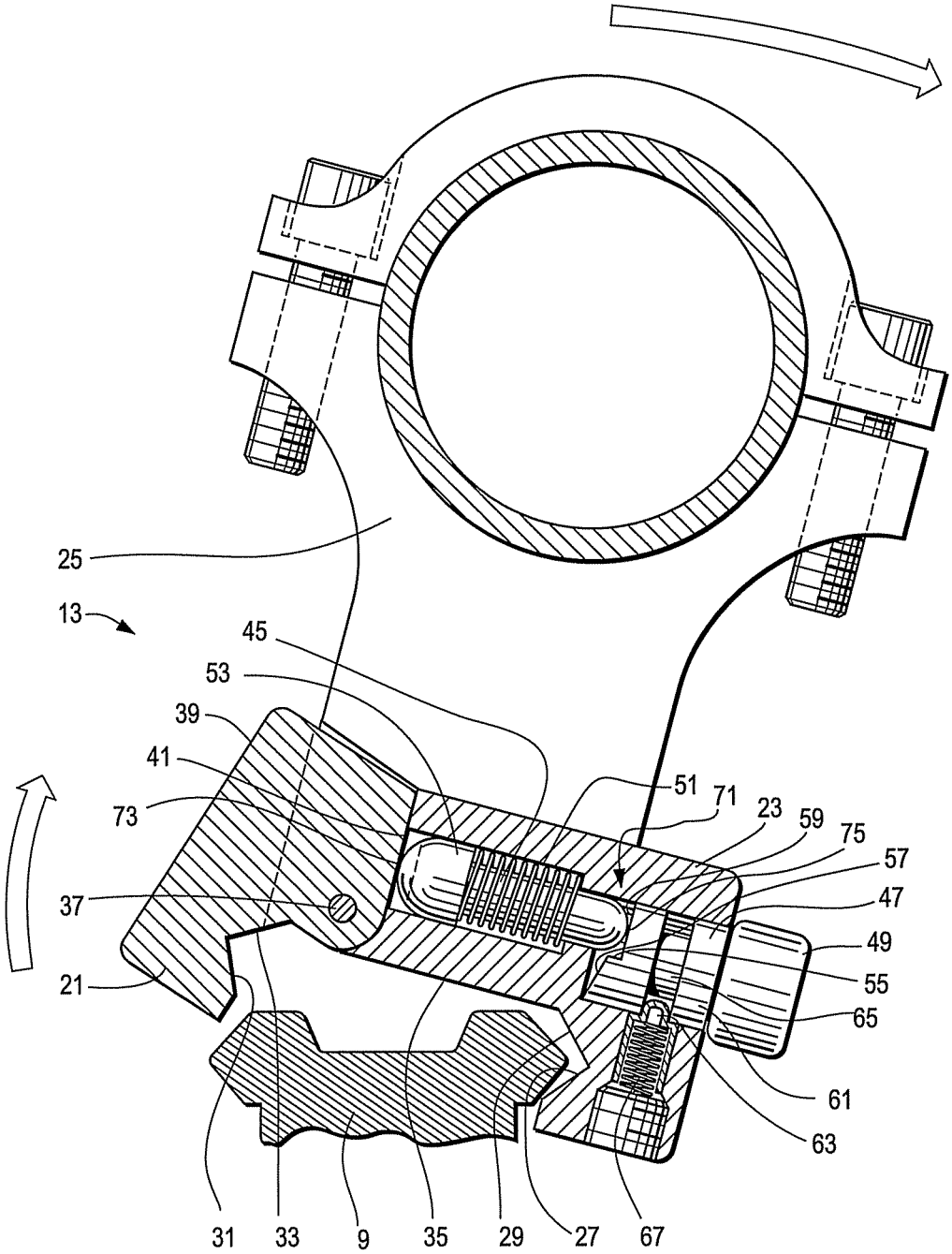
FIG. 5 is a rear elevation view, partly in section, of an embodiment of the mounting assembly with the clamp in a disengaged position.

The clamp 21 is attached to the base 23 by a pivot 37. The pivot 37 preferably comprises a pin that extends through the clamp 21 and connects the clamp with the base 23. The clamp 21 rotates on the pivot 37 between an engaged position and a disengaged position. (FIGS. 3 and 4 show the engaged position and FIG. 5 shows the disengaged position.) The clamp 21 is configured so that in its engaged position, a rail-engaging surface 31 of the clamp 21 may engage a rail 9. When engaged with a rail 9, the mounting assembly 13 grips the mounting projections 15 of a rail 9 between a rail-engaging surface 27 of the base 23 and a rail-engaging surface 31 of the clamp 21. Accordingly, the mounting assembly 13 is mounted on the rail 9.

The clamp 21 is further configured so that in its disengaged position, shown in FIG. 5, a rail-engaging surface of the clamp 31 may disengage a rail 9. When the clamp 21 is in its disengaged position, a rail 9 may be placed within or removed from the mounting cavity 35 of the assembly. The clamp 21 is preferably biased to its engaged position so that a user must perform some action to bring the clamp to its disengaged position.

The clamp 21 further comprises an outer surface, which includes at least a grip or finger pad 39 configured so that an applied force to the grip or finger pad will produce a rotation of the clamp on the pivot 37. This grip or finger pad may optionally be textured to provide an improved surface for gripping.

The clamp 21 also comprises an inner surface 41 that faces the base 23. In the illustrated embodiment, the clamp comprises an inner surface 41 that slopes downward toward the pivot 37, which is located toward the bottom of the inner surface. An inner surface, however, may take on a number of configurations. In the illustrated embodiment, a space 43 exists between at least a portion of an inner surface of the clamp 41 and an inner surface of the base 23 when the clamp is in its engaged position. Other embodiments may be effected, however, so long as a location adjacent to at least a portion of an inner surface of the clamp 41 accepts an insertion of the clamp 21 when the clamp rotates to its disengaged position.

An embodiment of the mounting assembly 13 also comprises a locking mechanism 71, which ensures that the mounting assembly maintains a secure engagement with a rail 9. The locking mechanism 71 preferably comprises at least a plunger 45, a cam 47, and an actuator 49.

The plunger 45 comprises a first end 73 that is in contact with an inner surface of the clamp 41. In a preferred embodiment, the first end of the plunger 73 is in operative contact with the clamp 21 to bias the clamp toward its engaged position. For example, the plunger 45 may comprise a spring 51, which operates to produce the bias of the first end of the plunger 73 against the clamp 21. In the illustrated embodiment, the spring 51 is wrapped about at least a portion of the plunger 45 and terminates at a head of the plunger 53. The plunger also comprises a second end 75 that faces the cam 47.

The cam 47 moves between at least a locked position, shown in FIG. 3 and an unlocked position, shown in FIG. 4. The cam 47 is configured so that in its locked position, it is operatively connected with the second end of the plunger 75 to prevent rotation of the clamp into its disengaged position. Conversely, the cam 47 is configured so that in its unlocked position, the clamp 21 may rotate into its disengaged position.

In the illustrated embodiment, the cam 47 comprises a cam surface 55 that faces the second end of the plunger 75. The cam surface 55 has at least a first, protruding, portion 57 and a second, recessed, portion 59. The first, protruding portion of the cam surface 57 extends further toward the plunger 45 than the second, recessed portion of the cam surface 59. In one embodiment, the first, protruding portion of the cam surface 57 juts out from the second, recessed portion of the cam surface 59. However, in another embodiment, the cam surface 55 may slope downward from the first, protruding portion of the cam surface 57 to the second, recessed portion of the cam surface 59. In the illustrated embodiment, the first, protruding portion of the cam surface 57 juts out from the second, recessed portion of the cam surface 59, and the first, protruding portion of the cam surface 59 is sloped.

When the cam 47 is in its locked position, the first, protruding, portion of the cam surface 57 is aligned with the second end of the plunger 75. Preferably, when the cam 47 is in its locked position, the first, protruding, portion of the cam surface 57 contacts the second end of the plunger 75, as shown in FIG. 3. When the cam 47 is in its unlocked position, the second, recessed, portion of the cam surface 59 is aligned with the second end of the plunger 75. Preferably, when the cam 47 is in its unlocked position, the second portion of the cam surface 59 is spaced from the second end of the plunger 75.

Preferably, the cam 47 rotates between its locked and unlocked positions. In a preferred embodiment, the cam 47 comprises a rounded surface 61 on which the cam rotates between its locked position and its unlocked position. As an example, the cam 47 may be rounded along its entire length, as shown in the illustrated embodiment. In another embodiment, the rounded surface of the cam 61 may rotate along a guide 63. Preferably, the rounded surface of the cam 61 comprises a groove 65. The groove 65 is configured to be in contact with the guide 63, which fits within the groove. The guide 63 may also be operatively connected to a spring 67, which provides resistance to the rotation of the cam 47 along the guide. While rotation is preferred, the cam 47 may move between locked and unlocked positions in other ways.

The actuator 49 is operatively connected to the cam 47 to move the cam between its locked and unlocked position. Preferably, the actuator 49 comprises a lever 77, which protrudes from the side of the base 23. In one embodiment, the lever 77 rotates 180 degrees, the endpoints of which correspond to the locked position and the unlocked position of the cam 47. For example, the lever 77 facing toward the rear of a rail 9 when the assembly 13 is mounted on a rail may correspond to the unlocked position of the cam 47. The lever facing toward the front of a rail 9 when the assembly 13 is mounted on a rail would thus correspond to the locked position of the cam 47.

The mounting assembly of the illustrated embodiment 13 allows a user to attach an accessory to a mounting rail 9 quickly and easily. First, a user will position the assembly 13 at a desired point on the rail 9. To position the assembly 13 on a rail 9, the clamp 21 is brought into its disengaged position. To bring the clamp 21 into its disengaged position, a user simply applies force to the grip or finger pad 39 on an outer surface of the clamp. A user may easily bring the clamp 21 into its disengaged position by gripping the mounting assembly 13 in one hand and applying force to the grip or finger pad 39 using the thumb or forefinger.

In an embodiment, the applied force causes an inner surface of the clamp 41 to push against the first end of the plunger 73. This causes a movement of the plunger 45 as to allow the rotation of the clamp 21 on the pivot 37. For instance, in the illustrated embodiment, the plunger 45 moves into the space that was located between the second end of the plunger 75 and the second portion of the cam surface 59. Thus, when the clamp 21 is rotated into its disengaged position, the second end of the plunger 75 is brought into contact with the second portion of the cam surface 59.

The rotation of the clamp 21 on the pivot 37 causes a rail-engaging surface of the clamp 31 to move outward. This brings the clamp 21 into its disengaged position, shown in FIG. 5. When the clamp 21 is maintained in its disengaged position, such as by a continued application of force against the grip or finger pad 39, the mounting cavity 35 of the assembly 13 may be positioned on a rail 9.

Next, the user mounts the assembly 13 on the rail 9. To mount the assembly 13 on the rail 9, the clamp 21 is brought into its engaged position, shown in FIG. 4. Because the clamp 21 is biased to its engaged position, the user may simply release the force applied to the grip or finger pad 39. For instance, in the illustrated embodiment, when the applied force is released, the spring 51, which was compressed during rotation of the clamp 21 to its disengaged position, causes the head of the plunger 53 to push against an inner surface of the clamp 41. This causes the plunger 45 to move away from the second portion of the cam surface 59 and toward the clamp 21, pushing the clamp into its engaged position.

The rotation of the clamp 21 to its engaged position causes a rail-engaging surface of the clamp 31 to move inward and into engaged contact with a mounting surface of the rail 21. Because the rail-engaging surface of the clamp 31 and the rail-engaging surface of the base 27 are configured for engaged contact with the rail 9 when the clamp 21 is in its engaged position, the mounting assembly 13 becomes mounted on the rail.

If relocation of the assembly 13 is desired, the user simply reapplies force to the grip or finger pad on the outer surface of the clamp 39, causing the clamp 21 to rotate to its disengaged position. The user then relocates the assembly 13 to a desired position on the rail 9, and releases the force to the grip or finger pad 39, causing the clamp 21 to rotate back to its engaged position.

Once the assembly 13 is mounted on the rail 9, the assembly may be locked in place using a locking mechanism 71, which locks the clamp 21 in its engaged position. Although a preferred embodiment is described and illustrated herein, the locking mechanism 71 is not limited to this preferred embodiment. Using the actuator 49, the user rotates the cam 47 from its unlocked position, shown in FIG. 4, to its locked position, shown in FIG. 3. Accordingly, the first portion of the cam surface 57 is brought into contact with the second end of the plunger 75. This fixes the plunger 45 in place, with its first end 73 in contact with an inner surface of the clamp 41 and its second end 75 in contact with the cam surface 57. Thus, although a user may apply force to a grip or finger pad on an outer surface of the clamp 39, the plunger 45 may not move so as to allow rotation of the clamp 21 from its engaged position. Because the clamp 21 may not rotate, a rail-engaging surface 31 of the clamp is secured to the rail 9 so that the assembly 13 will not be loosened or dislodged during use.

To rotate the cam 47 into its locked position, the user preferably moves a lever 77 in a 180 degree arc. Preferably the lever 77 rotates in an upward arc between its two endpoints to ensure that the firearm 1 or other device on which the rail 9 is affixed does not interfere with the movement of the lever. In one embodiment, the user brings the lever 77 from a position facing the rear of a rail 9, and corresponding to the unlocked position of the cam 47, to a position facing the front of a rail, corresponding to the locked position of the cam.

In a further preferred embodiment, a guide 63 ensures that operation of the actuator 49, preferably a lever 77, requires an appropriate amount of force. In this embodiment, the cam 47 rotates between its unlocked and locked positions on a guide 63. The guide 63 sits in a groove of the cam 65, and serves to hold the cam 47 in place while it rotates. A spring 67, in contact with the guide 63, operates to push the guide into the groove of the cam 65, creating friction between the guide and the cam 47 when the cam rotates. By creating a degree of resistance to rotation of the cam 47, the guide 63 thereby ensures that the cam does not too easily rotate between its unlocked and locked positions.

A user may remove the mounting assembly in the same user-friendly manner in which it is attached. To detach the assembly 13, a user, through the actuator 49, brings the cam 47 into its unlocked position, shown in FIG. 4. Accordingly, the second portion of the cam surface 59 is aligned with the second end of the plunger 75. In the illustrated embodiment, this introduces a space between the second end of the plunger 75 and the cam surface 59. Next, the user brings the clamp 21 into its disengaged position. To do so, the user applies force to the grip or finger pad on the outer surface of the clamp 39. In the manner described above, the clamp 21 rotates on its pivot 37, causing a rail-engaging surface of the clamp 31 to pivot outward and out of engaged contact with the rail 9, as illustrated in FIG. 5. By maintaining the mounting assembly 13 in this position, such as through continued application of force the grip or finger pad 39, the mounting assembly 13 may be removed from a rail 9.

Through operation of an embodiment of the mounting assembly 13 as described above, an accessory may be quickly and easily located onto a desired location of a mounting rail 9 and mounted thereto. With similar ease, the assembly 13 may be firmly secured to the rail 9 through a locking mechanism 71.

The mounting assembly is not limited to the embodiment illustrated in FIGS. 2 through 5. One aspect of the assembly that may be altered, in order to accommodate different accessories, is the manner by which the clamp and the base are connected. For example, the embodiments of FIGS. 6 and 7 have different configurations for the clamp 21 and base 23.

Figure 6:
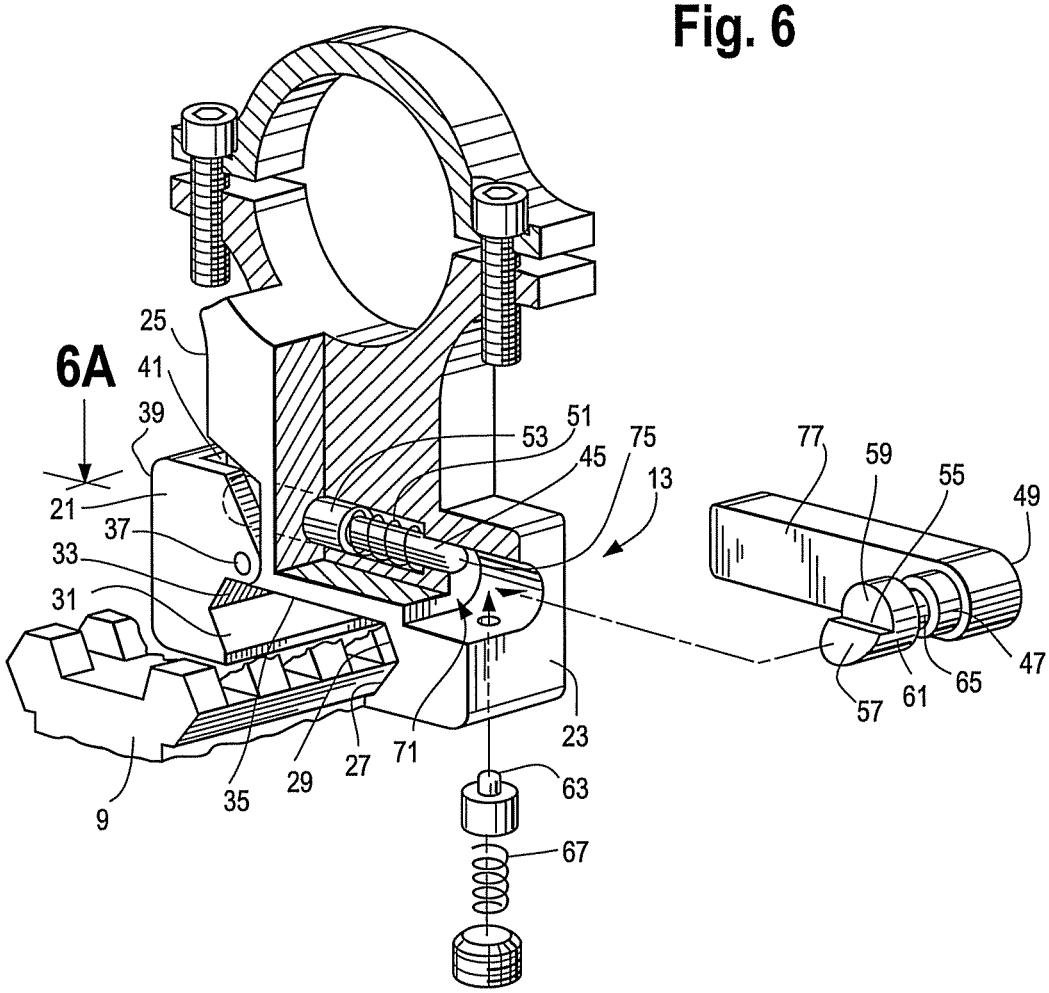
FIG. 6 is an exploded perspective view, partly in section, of an embodiment of the mounting assembly configured for mounting a scope ring on a Picatinny-type rail.
Figure 6A:
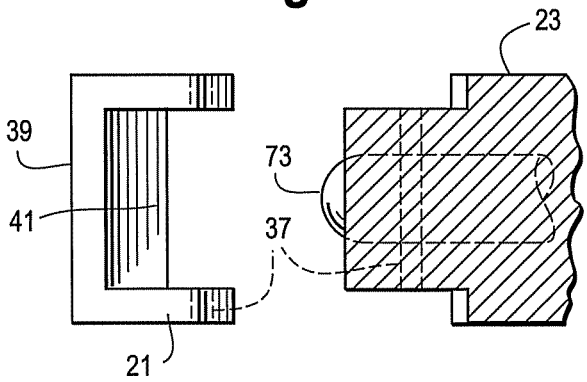
FIG. 6A is an exploded top plan view of an embodiment of the mounting assembly configured for mounting a scope ring on a Picatinny-type rail.

FIG. 6 illustrates an embodiment of the mounting assembly 13 configured for mounting a scope ring 25 on a Picatinny-type rail 9. In this embodiment, an inner surface of the clamp 41 is recessed from the pivot 37. Because the first end of the plunger 73 contacts the inner surface of the clamp 41, the plunger 45 will have an increased length over that in the embodiment of FIGS. 2-5. Yet operation of the clamp 21 and the locking mechanism 71 of the embodiment of FIG. 6 are fundamentally as described above. FIG. 6A is an exploded top plan view of the embodiment of the mounting assembly illustrated in FIG. 6 and described herein. FIG. 6A shows how the inner surface of the clamp 41 is recessed from the pivot 37, which is depicted by a dotted line. When the the clamp 21 is brought together with the base 23, the two are connected by the pivot 37.

Figure 7:
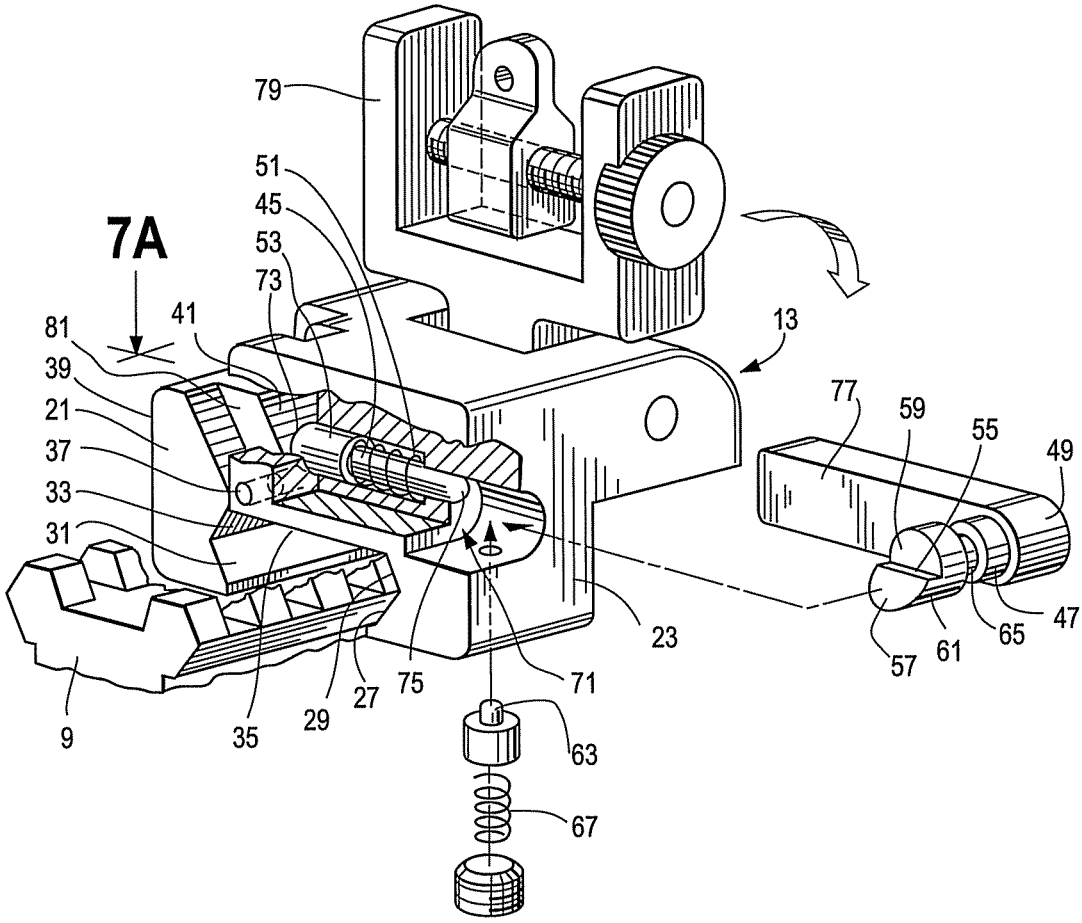
FIG. 7 is an exploded perspective view, partly in section, of an embodiment of the mounting assembly configured for mounting a flip-up sight on a Picatinny-type rail.
Figure 7A:
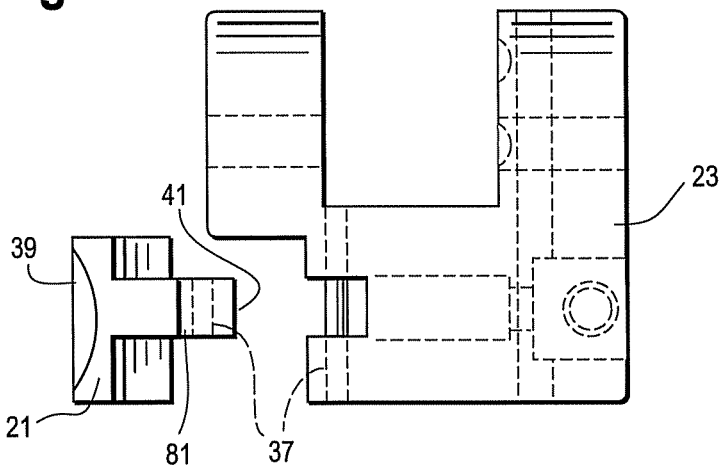
FIG. 7A is an exploded top plan view of an embodiment of the mounting assembly configured for mounting a flip-up sight on a Picatinny-type rail.

FIG. 7 illustrates another embodiment of the mounting assembly 13 that is configured for mounting a flip-up sight 79 on a Picatinny-type rail 9. In this embodiment, the clamp 21 comprises a protruding portion 81 that extends further into the base 23 than the rest of the clamp. It is through the protruding portion of the clamp 81 that the pivot 37 connects the clamp 21 and the base 23. It is also the inner surface 41 of the protruding portion of the clamp 81 that is in contact with the first end of the plunger 73. Again, operation of the clamp 21 and the locking mechanism 71 of the embodiment of FIG. 7 are fundamentally as described above. FIG. 7A is an exploded top plan view of the embodiment of the mounting assembly illustrated in FIG. 7 and described herein. FIG. 7A shows how the inner surface of the clamp 41 is located on a protruding portion of the clamp 81. When the clamp 21 and the base 23 are brought together, the pivot 37, which is depicted by a dotted line, connects the clamp to the base through the protruding portion of the clamp 81.

Accordingly, embodiments of the mounting assembly allow a user, using only a single hand, to mount and secure an accessory to a firearm in a matter of seconds. Because detachment of the assembly from a rail is equally user-friendly, a user could also replace one accessory on a rail with another in a matter of seconds. Further, embodiments of the mounting assembly may be easily mounted on a rail and detached from the rail using either of one's hands.

Moreover, the streamlined design of embodiments of the mounting assembly provides a level of durability that is not thought to exist in the prior art designs. An embodiment utilizes a clamp 21 that is, itself, an integral part of the mounting assembly 13 and a locking mechanism 71 that is predominantly located inside the mounting base 23. As a result, an embodiment of the mounting assembly contains fewer external parts than the devices of the related art. The streamlined design of embodiments of the mounting assembly allows it to undergo the stresses of combat with less external pieces that could be broken or otherwise fail. Moreover, the mounting assembly does not risk being contaminated with mud, sand, or other elements of nature and/or combat, with which the devices are likely to come into contact. The total effect is thought to be a more reliable assembly 13 for mounting an accessory on a rail 9 that is affixed to a firearm 1. As an added benefit, the use of fewer parts is thought to decrease the cost of production.

It can be seen that the described embodiments provide a unique and novel mounting assembly that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A method of securing a firearm accessory to a firearm having a mounting rail affixed thereto, comprising:

a. providing a firearm accessory comprising a base and a clamp, the base having a first rail-engaging surface, the clamp having a second rail-engaging surface, the space between the rail-engaging surfaces defining a mounting cavity, and wherein the clamp is biased toward an engaged position by a plunger;

b. bringing a clamp of the firearm accessory into a disengaged position by causing the clamp to rotate on a pivot;

c. placing the rail within the mounting cavity of the accessory; and d. allowing the plunger to automatically bias the clamp to its engaged position, such that the rail is gripped between the rail-engaging surface of the clamp and the rail-engaging surface of the base.

2. The method of claim 1, wherein the firearm accessory is selected from the group consisting of flashlights, laser spotters, hard sights, flip-up sights, scopes, scope rings, and combinations thereof.

3. The method of claim 1, wherein bringing a clamp of the mounting assembly into a disengaged position comprises applying a force to an outer surface of the clamp.

4. The method of claim 3, wherein the firearm accessory is gripped in one hand and the force is applied to an outer surface of the clamp using a thumb or forefinger.

5. The method of claim 3, wherein allowing the plunger to automatically bias the clamp to its engaged position comprises removing the force being applied to an outer surface of the clamp.

6. The method of claim 1, further comprising locking the clamp in its engaged position, such that the mounting assembly is firmly secured to the rail.

7. The method of claim 6, wherein locking the clamp in its engaged position comprises turning an actuator associated with the firearm accessory to rotate a cam, thereby fixing the plunger between a surface of the clamp and a surface of the cam.

8. The method of claim 7 wherein the actuator comprises a lever and locking the clamp in its engaged position comprises moving the lever in a 180 degree arc.

9. The method of claim 8 comprising moving the lever either (a) from a position facing the rear of the rail to a position facing the front of the rail or (b) from a position facing the front of the rail to a position facing the rear of the rail.

10. A method of securing a firearm accessory to a firearm having a mounting rail affixed thereto, comprising:

a. providing a firearm accessory comprising a base and a clamp, the base having a first rail-engaging surface, the clamp having a second rail-engaging surface, the space between the rail-engaging surfaces defining a mounting cavity, and wherein the clamp is biased toward an engaged position by a plunger;

b. bringing the clamp of the firearm accessory into a disengaged position by applying a force to an outer surface of the clamp;

c. placing the rail within the mounting cavity of the accessory; and d. allowing the plunger to automatically bias the clamp to its engaged position, such that the rail is gripped between the rail-engaging surface of the clamp and the rail-engaging surface of the base.

* * * * *